US009620912B2

(12) United States Patent
Wu

(10) Patent No.: US 9,620,912 B2
(45) Date of Patent: Apr. 11, 2017

(54) CONNECTOR MODULE

(71) Applicant: Dinkle Enterprise Co., Ltd., New Taipei (TW)

(72) Inventor: Shang-Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 136 days.

(21) Appl. No.: 14/803,542

(22) Filed: Jul. 20, 2015

(65) Prior Publication Data

US 2016/0336666 A1 Nov. 17, 2016

(30) Foreign Application Priority Data

May 13, 2015 (TW) ..... 104115278 A

(51) Int. Cl.

| | |
|---|---|
| ***H01R 13/625*** | (2006.01) |
| ***H01R 13/703*** | (2006.01) |
| ***H01R 12/72*** | (2011.01) |
| *H01R 13/24* | (2006.01) |

(52) U.S. Cl.

CPC ..... *H01R 13/7031* (2013.01); *H01R 12/721* (2013.01); *H01R 13/245* (2013.01)

(58) Field of Classification Search

CPC ..... H01R 9/26; H01R 13/629

USPC ..... 439/928, 341, 715–716, 912

See application file for complete search history.

(56) References Cited

U.S. PATENT DOCUMENTS

| | | | | |
|---|---|---|---|---|
| 3,992,653 | A * | 11/1976 | Richardson | H05K 7/1404 165/80.3 |
| 4,096,547 | A * | 6/1978 | Calabro | H05K 7/20545 361/708 |
| 4,956,747 | A * | 9/1990 | Beer | H01R 9/2675 361/600 |
| 5,716,241 | A | 2/1998 | Hennemann et al. | |
| 6,425,770 | B1 * | 7/2002 | Lostoski | H01R 9/26 361/759 |
| 7,402,058 | B2 | 7/2008 | Hoemann et al. | |
| 7,566,234 | B2 * | 7/2009 | Hackemack | H01R 9/2458 200/51.1 |
| 7,690,952 | B2 * | 4/2010 | Koellmann | H01R 9/26 439/716 |
| 2013/0027890 | A1 | 1/2013 | Berger et al. | |

FOREIGN PATENT DOCUMENTS

WO WO 00/62376 A1 10/2000

* cited by examiner

*Primary Examiner* — Phuongchi T Nguyen

(74) *Attorney, Agent, or Firm* — Muncy, Geissler, Olds & Lowe, P.C.

(57) ABSTRACT

Disclosed is a connector module comprising an insulation main body including a slot and groups of connection terminals fixed to the insulation main body, with each group of connection terminals including a first contact piece and a second contact piece. The first contact piece provides an external first contact and internal second and third contacts, arranged along a first direction in the slot. The second contact piece provides an external fourth contact and internal fifth and sixth contacts, arranged along the first direction in the slot and in resilient contact with the second and third contacts, respectively. When an external object enters into the slot in the first direction, contact between the second and fifth contacts or the third and sixth contacts is released.

13 Claims, 5 Drawing Sheets

CONNECTOR MODULE

FIELD OF THE INVENTION

The present invention relates to a connector module, particularly a connector module providing a hot-swap capability.

BACKGROUND OF THE INVENTION

In industrial control applications, various control circuits are formed in functional modules and a plurality of control modules is removably installed in a control system, to provide the system with different control functions. In order to satisfy such needs, i.e., the need of adding or removing particular module from time to time, each functional modules is provided with necessary connector modules, with a same number of electrical contacts at identical positions among all connector modules. In particular, the various functional modules form a flat cassette, with their electrical contacts formed in both sides of the flat cassettes at respectively identical positions, so that a cassette can establish electrical connections with another adjacent to either side of the other at the electrical contacts, in order to exchange signals or power.

U.S. Pat. No. 5,716,241 disclosed an "I/O Device for a Data Bus" including a connector module having such modularized connectivity. The connector module is used in a module cassette.

In order to support connections of function modules, the industry has developed a connector module. The connector module has main body in the shape of a flat cassette, with a same number of contact pins at corresponding positions in its both sides, such that one other connector module, also in the shape of a cassette, can establish electrical connections at either side of the cassette. The contact pins of a pair form a T shape, with two pins respectively extended to both sides and a third pin extended in a perpendicular direction. As a general design, the third pin includes two elastic legs configured to clip an external connector, such as one of the goldfingers provided in a circuit board. When the external connector is inserted in the third connector, the functional module in connection with the external connector establishes electrical contact with the T-shaped connector piece. That is, when no external connector is inserted, the T-shaped connector piece conducts laterally, called short circuit; when the external connector is inserted, the T-shaped connector piece additionally conducts the functional module in connection with the external connector.

WO 00/62376A1 disclosed an "Input/Output Device Having Removable Module" that has a connector module provided with such function. A T-shaped connector piece for use in the connector module is also disclosed.

US 2013/0027890 disclosed a "Connection Module Being Capable of Serving a Bus" that uses a plurality of connector modules to form a bus structure.

Changing the interconnection among contact pins by inserting a foreign object in a group of connectors was disclosed in U.S. Pat. No. 7,402,058, "Plug Connector with Short Circuit Contacts."

In the prior art, inserting/removing either a conductive object or an insulating object to change the interconnection of a group of connectors would easily cause the sudden short or break in the circuit, during the process of insertion or removal. Such operation in turn easily cause surge or arc in the connector module or the functional module connected thereto, resulted in mail-function or even damages of the modules.

Therefore, it is necessary to provide a novel connector module that can prevent sudden short or break during operation, without the need of a complicated structure.

It is also necessary to provide a connector module that provides a plurality of connection modes and is able to prevent sudden short or break during switching of the connection modes.

SUMMARY OF THE INVENTION

An objective of the present invention to provide a novel connector module that can prevent sudden short or break during operation, without the need of a complicated structure Another objective of this invention is to provide a connector module that supports a plurality of connection modes and is able to prevent sudden short or break during switching of the connection modes.

According to the present invention, a connector module is provided comprises: an insulation main body having a slot;

at least one group of connection terminals fixed on the insulation body, each group of connection terminals including a first contact piece and a second contact piece; wherein the first contact piece provides an external first contact and internal second and third contacts, the internal second and third contacts being arranged along a first direction in the slot;

the second contact piece provides an external fourth contact and internal fifth and sixth contacts, the internal fifth and sixth contacts being arranged along the first direction in the slot and in resilient contact with the second and third contacts, respectively; and a width of the slot in the direction perpendicular to the first direction is enough to accommodate a foreign object, whereby when the external object enters into the slot in the first direction, contact between the second and fifth contacts or the third and sixth contacts is released.

In the preferred embodiments of the invention, the first contact piece comprises a connection portion and a first elastic leg, a second elastic leg and a third elastic leg extended from the connection portion, such that the first contact, the second contact and the third contact are provided in the first elastic leg, the second elastic leg and the third elastic leg, respectively. In some preferred embodiments of the present invention, the second contact piece comprises a main body and a fourth elastic leg, a fifth elastic leg and a sixth elastic leg extended from the main body, such that the fourth contact, the fifth contact and the sixth contact are provided in the fourth elastic leg, the fifth elastic leg and the sixth elastic leg, respectively.

In certain preferred embodiments of the invention, the first contact is positioned on the external of a first side of the insulation body and the fourth contact is positioned on the external of a second side of the insulation body opposite to the first side. In such embodiments, at least a portion of the first elastic leg is arranged on the external of the first side of the insulation main body and at least a portion of the fourth elastic leg is arranged on the external of the second side of the insulation main body.

In several embodiments, the third elastic leg surrounds at least a portion of the second elastic leg, with a space between them. In addition, the sixth elastic leg surrounds at least a portion of the fifth elasticity leg, with a space between them. In these examples, the third elastic leg may surround the entire second elastic leg and the sixth elastic leg may also surround the entire fifth elastic leg.

In the embodiments of the present invention, when a foreign object is inserted into the slot along the first direction, the foreign object first contacts the second and fifth contacts. With the continued movement of the foreign object towards the first direction, connection of the second and fifth contacts is forced to break, therefore the contact status of the second contact and the fifth contact is released. The foreign object continues to move along the first direction and contacts the third contact and sixth contacts. With the continued movement of the foreign object, connection of the third contact and sixth contacts is forced to break, therefore the contact status of the third and sixth contacts is released.

The foreign object may provide an electrical contact at each side. The electrical contacts may be provided at locations corresponding to the second and fifth contacts, after the foreign object is fully inserted in the slot. The electrical contacts may also be provided at locations corresponding to the second and fifth contacts and extend to locations corresponding to the third and sixth contacts. The foreign object may be a circuit board and the electrical contacts may be goldfingers provided on the circuit board.

When the foreign object reaches the bottom of the slot and forces the third and sixth contacts to break, depending on the length of the electrical contacts the electrical contacts may form contact with the second and fifth contacts, only, or with the second, fifth, third and sixth contacts at the same time. In case the electrical contacts form contact with the second, fifth, third and sixth contacts, signals/currents that enter from the first contact and flow through connection of the second and fifth contacts and connection of the third and sixth contacts to the fourth contact without the foreign object being inserted will flow to the circuit provided in the circuit board through the electrical contacts and are output after they are processed/transformed. A serial connection of the circuit board is thus realized. On the other hand, if the electrical contacts only contact the second and fifth contacts, the signals/currents that enter from the first contact and flow to the fourth contact without the foreign object being inserted will split a flow to the circuit provided in the circuit board, because of the connection of the second and fifth contacts. The split flow is then output after it is processed and transformed. A parallel connection of the circuit board is thus realized.

In the process described above, when the foreign object forces the second and fifth contacts to open, the third and sixth contacts remain in contact, maintaining an electrical conductivity in the circuit. Sudden break in the circuit is thus prevented. On the other hand, when the foreign object moves in the opposite direction to leave the slot, the third and sixth contacts will first resume in contact and connection, due to the removal of the foreign object, while the second and fifth contacts remain in contact in the process. Therefore, a sudden short in the circuit may be avoided.

The present invention also discloses a connector module comprising a plurality of contact pieces having the features described above, as well as a connector assembly comprising a plurality of the connector module.

These and other objectives and advantages of the present invention may be made clear from the detailed description by reference to the following drawings.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION OF THE INVENTION

In the following, detailed description to the preferred embodiments of the connector module of this invention will be given by referring to the accompanying drawings. It is appreciated that the preferred embodiments are used to show the structure and the applications of some examples of the invention. The scope of protection of this invention shall be defined by the accompanying claims.

"Hot swap" generally refers to the functionality of a connector that protects the two components connected by the connector or the signals transmitted between the two components from damages, when the connector forms contact with or is removed from another connector. This feature can effectively prevent or eliminate a possibly sudden surge or arc generated when one connector is inserted into or removed from another.

It is an objective of the present invention to provide a connector module that supports the hot-swap feature.

Figure 1:
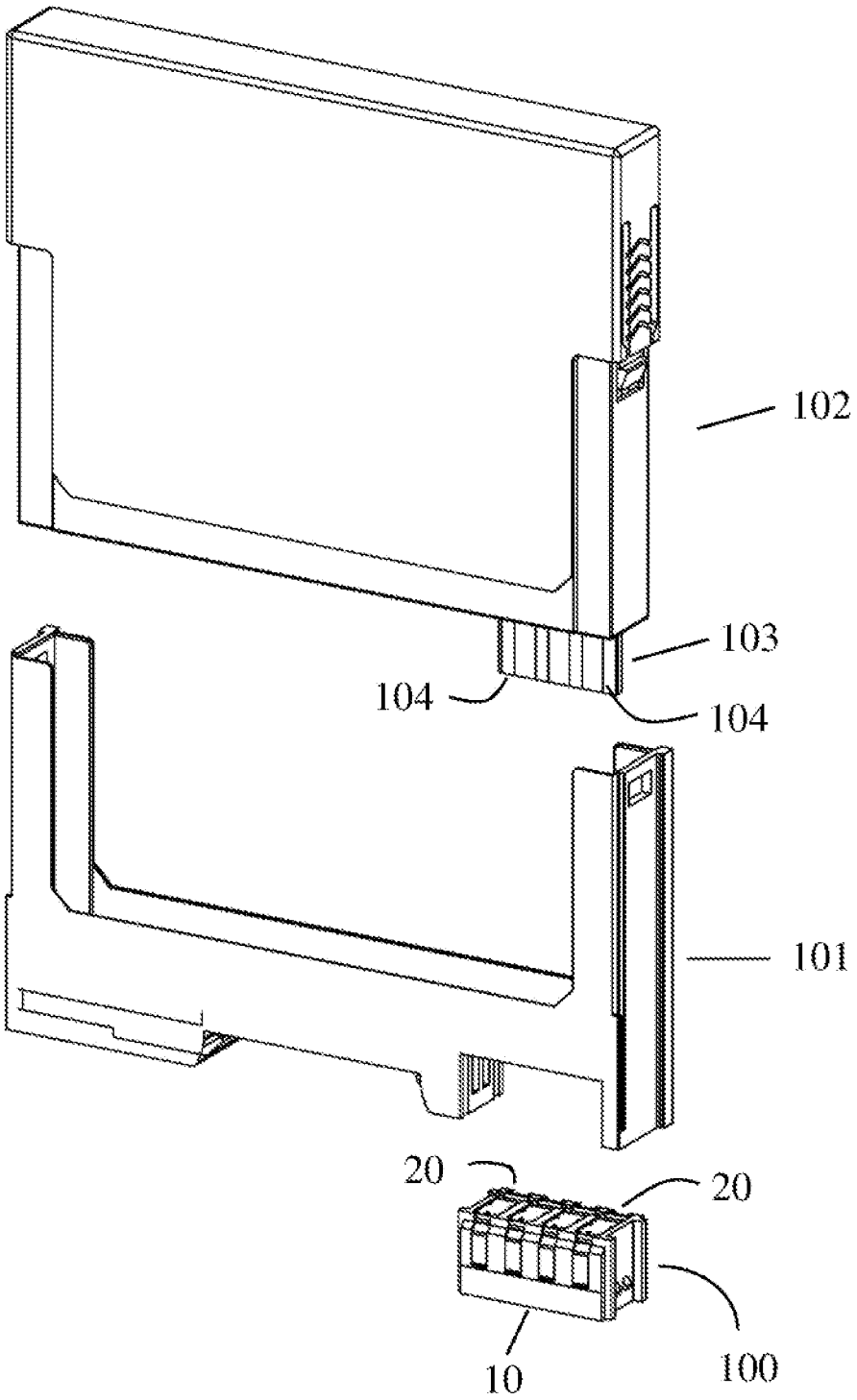
FIG. 1 shows the schematic view of a functional module using the connector module of the present invention.

FIG. 1 shows a schematic view of the connector of the present invention, when it is used in a functional module. As shown, the connector module 100 of the present invention comprises an insulation main body 10 and groups of connection terminals 20, 20 disposed on the insulation main body 10. In FIG. 1 only one side of the connector module 100 is shown. After the connector module 100 is assembled with the housing 101, the connector module 100 is in the lower side of the housing 101. The housing 101 provides guidance and protection. Rails (not drawings) may be provided in the housing 101, to guide a functional module 102 when it is inserted in the housing 101. A circuit board 103 extends from the function module 102. On the circuit board 103 a plurality of contact pins 104 is provided. In the embodiment of FIG. 1 the contact pins 104 are goldfingers 104 provided in the circuit board 103. When the functional module 102 continues its movement towards lower side of the figure, the plurality of contact pins 104 enters the slot (see FIG. 2) of the connector module 100 along with the exposed circuit board 103, such that the groups of connection terminals 20 form electrical contacts with the contact pins 104 of the circuit board 103.

Necessary electrical or electronic components are provided in the extended regions of the circuit board 103 located in the functional module 102, to transform or process electrical currents or electronic signals entered via the contact pins 104 and the connection terminal groups 20. Results of the transformation or processing are then output via corresponding connection terminal groups 20 or additional contact pins provided in the functional module 102. Functionality of the functional module 102 is thus realized.

Number of connection terminal groups 20 and contact pins 104 shown in the figure is not any technical limitation. In addition, number of connection terminal groups 20 provided in the contactor module 100 is not necessarily equal to number of contact pints 104 provided in the connector module 102.

Figure 2:
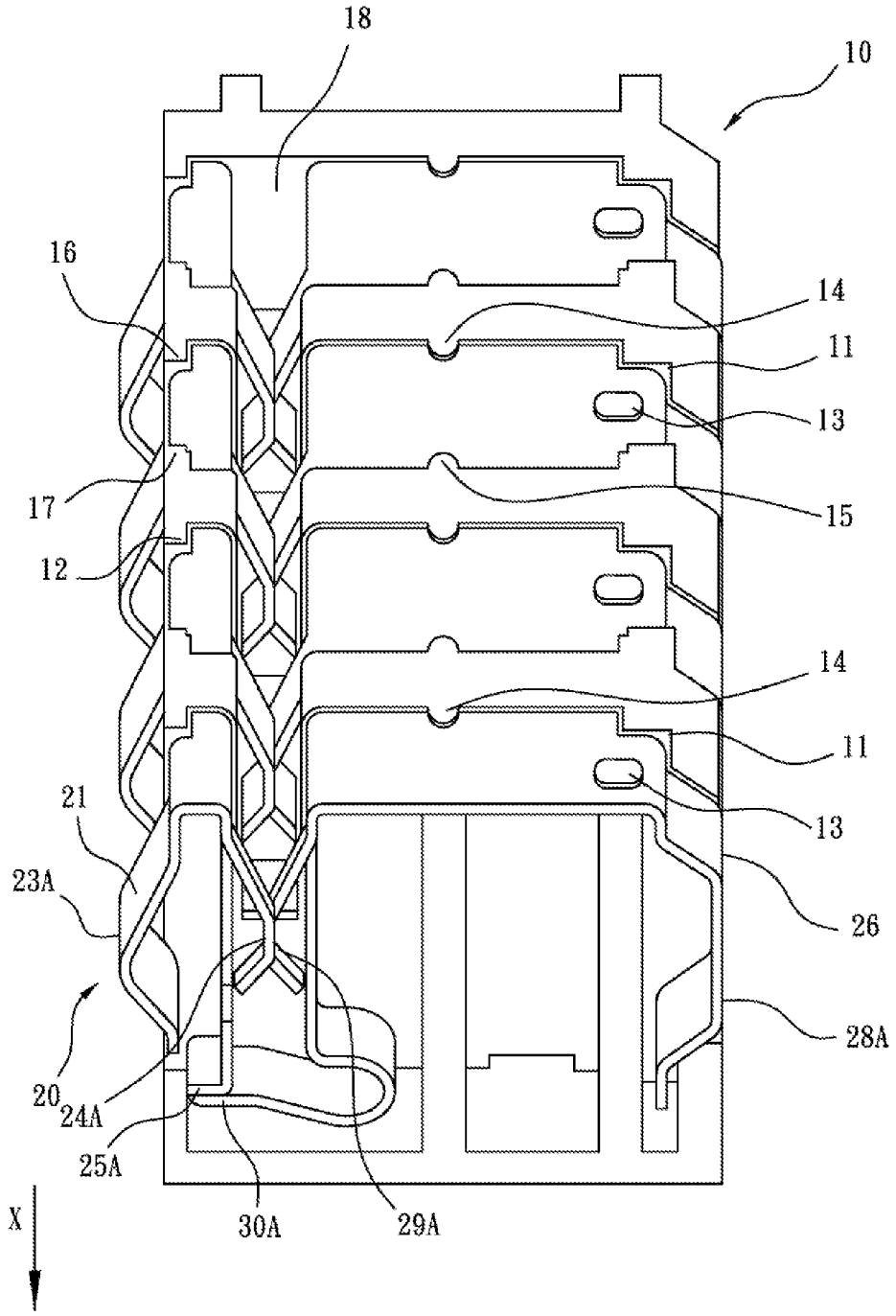
FIG. 2 shows the structural of an embodiment of the connector module of the present invention.

FIG. 2 shows the structural of the connector module 100 of an embodiment of the present invention. The figure shows four groups of connection terminal 20, as well as the side view of one of the connection terminal groups 20. As illustrated, in the present embodiment, the connector module 100 includes an insulation main body 10, with 4 groups of connection terminals 20 detachably fixed in the insulation main body 10 via slots 11, 12 and tabs 13, 14 16, 17, etc. The arrangement of the connection terminal groups 20 in the insulation main body 10 is not limited to the way shown in this figure. Any method that is able to affix the connection terminal groups 20 may be used in this invention. For example, the connection terminal groups 20 may be affixed in the insulation main body by injection. Number of the connection terminal group 20 may also vary in accordance with needs in applications.

The insulation main body 10 provides a slot 18 extending along the longitudinal direction of the insulation main body 10. Its length and width are not limited but generally, its length is preferably sufficient to accommodate the predetermined number of connection terminal groups, while maintaining a predetermined distance between the groups. In addition, its width is preferably sufficient to accommodate the connection terminals therein, while leaving a space for a foreign objects, such as the circuit board 103, to be inserted therein.

Each group of connection terminals shown in FIG. 20 comprises a first contact piece 21 and a second contact piece 26. As shown in the figure, the first contact piece 21 provides a first contact 23A, a second contact 24A and a third contact 25A, with the second and third contacts 24A, 25A located in the slot 18 and arranged along a first direction X in the slot 18. The figure also shows that the second contact piece 26 provides a fourth contacts 28A, a fifth contact 29A and a sixth contact 30A, with the fifth and sixth contacts 29A, 30A located within the slot 18 and arranged along the first direction X. In addition, the fifth and sixth contacts 29A, 30A respectively form resilient contact with the second and third contacts 24A, 25A.

Figure 3A:
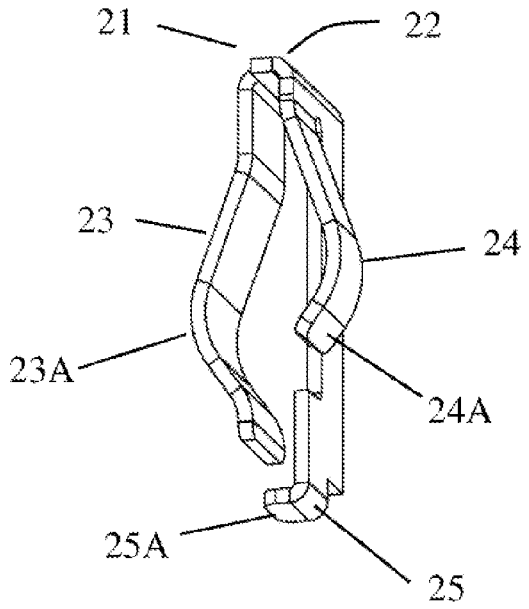
FIG. 3A is the oblique drawing of an embodiment of the first contact piece used in the connector module of this invention.

FIG. 3A shows the oblique view of an embodiment of the first contact piece 21 used in the connector module of this invention. As shown, in this embodiment the first contact piece 21 includes a connection portion 22 and first elastic leg 22, second elastic leg 24 and third elastic leg 25 extended from the connection portion 22. The first contact 23A, the second contact 24A and the third contact 25A are respectively provided in the first elastic leg 23, the second elastic leg 24 and the third elastic leg 25. When assembled, the second elastic leg 24 and the third elastic leg 25 of the first contact piece 21 are aligned with the slot 18 and pushed into the slot 18 so that the second and third elastic legs 24, 25 enter into the slot 18, while the first elastic leg 23 maintained external to the slot 18, until edge 18A of the slot 18 is in connection with the connection portion 22.

Figure 3B:
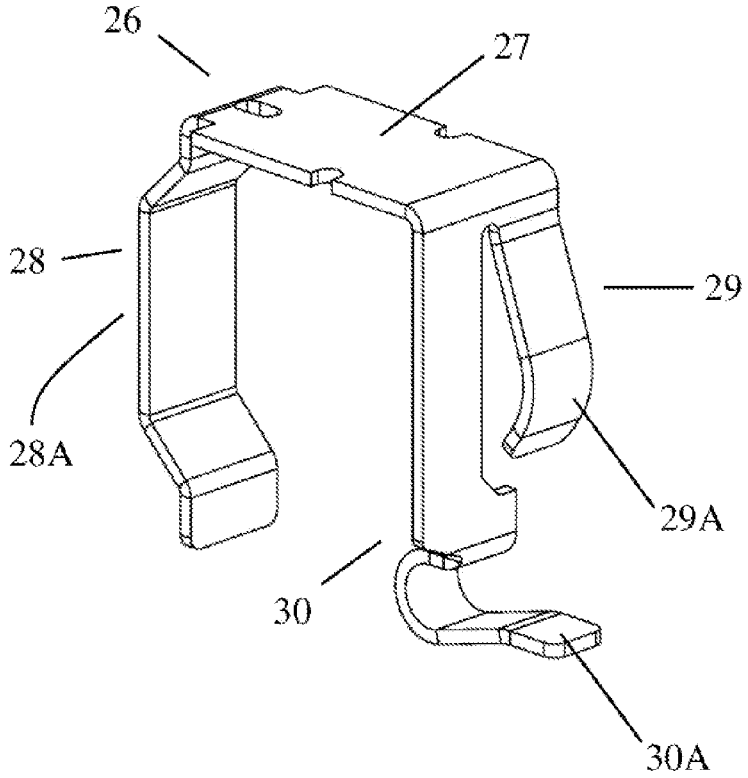
FIG. 3B is the oblique drawing of an embodiment of the second contact piece used in the connector module of this invention.

Now refer to FIG. 3B. FIG. 3B shows the oblique view of an embodiment of the second contact piece 26 used in the connector module of this invention. As shown, in this embodiment the second contact piece 26 includes a main body 27 and fourth elastic leg 28, fifth elastic leg 29 and sixth elastic leg 30 extended from the main body 27. The fourth contact 28A, the fifth contact 29A and the sixth contact 30A are respectively provided in the fourth elastic leg 28, the fifth elastic leg 29 and the sixth elastic leg 30. Similar to the first contact piece 21, when assembled, the fifth elastic leg 29 and the sixth elastic leg 30 of the second contact piece 27 are aligned with the slot 18 and pushed into the slot 18 so that the fifth and third sixth legs 29, 30 enter into the slot 18, while the fourth elastic leg 28 maintained external to the slot 18, until edge 18A of the slot 18 is in connection with the main body 27.

After assembly, in each of the connection terminal groups 20, the first contact 23 locates outside of one external side of the insulation main body 10 and the fourth contact 28 on the opposite external side of the insulation main body 10. The first elastic leg 23 and the fourth elastic leg 28 may be disposed in the external sides of the insulation main body 10 in full or in part, as long as they may form electrical contact with a group of identical or similar connection terminal belonging to another connector module.

Figure 4A:
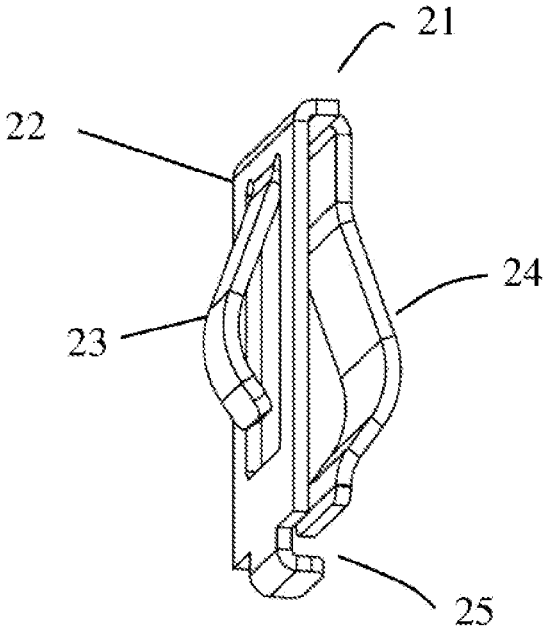
FIG. 4A is the oblique drawing of another embodiment of the first contact piece used in the connector module of this invention.
Figure 4B:
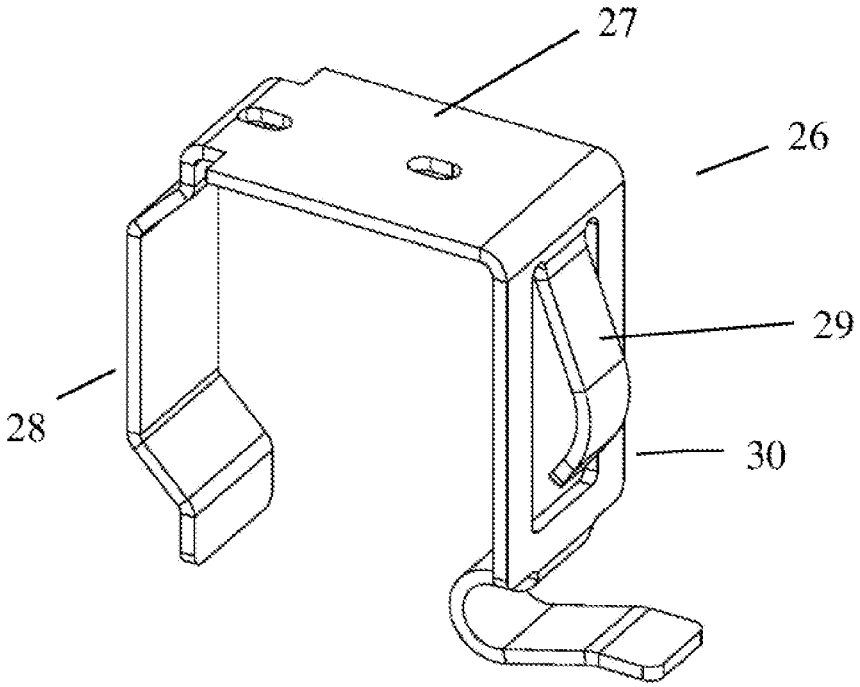
FIG. 4B is the oblique drawing of another embodiment of the second contact piece used in the connector module of this invention.

In the example shown in FIG. 3A, the extensions of the third elastic leg 25 and the second elastic leg 24 are separated by a space. Also, in the example shown in FIG. 3B, the extensions of the sixth and fifth elastic legs 30 29 are separated by a space. However, in other examples, the second elastic leg 24 may be surrounded by the third elastic leg 25 with a space between them, to form a frame shape, as shown in FIG. 4A. Similarly, the fifth elastic leg 29 may be surrounded by the sixth elastic leg 30, with a space between them, to form a frame shape, as shown in FIG. 4B. Other designs in the type, shape or structure of the elastic legs are applicable and may be determined by those having ordinary skills in the art.

When the connector module 100 of the invention is assembled, each group of the connection terminals 20 will have the second and third contacts 24A, 25A arranged along the first direction X within the slot 18, and the fifth and sixth contacts 28A, 29A arranged along the first direction X in the slot 18. The fifth and sixth contacts 28A, 29A form resilient contacts respectively with the second and third contacts 24A, 25A. The width of the slot 18 in the direction perpendicular to the first direction X is wide enough to accommodate a foreign object, such as the circuit board 103. Therefore, the foreign object 103 can enter the slot 18:00 to release the contact status of the second contact 24A with the fifth contact 29A, and the third contact 25 with the sixth contact 30A.

Figure 5A:
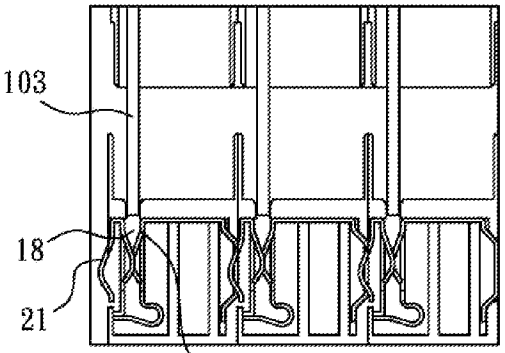
FIGS. 5A-5C show the cross-sectional view of the invented connector module in application.
Figure 5B:
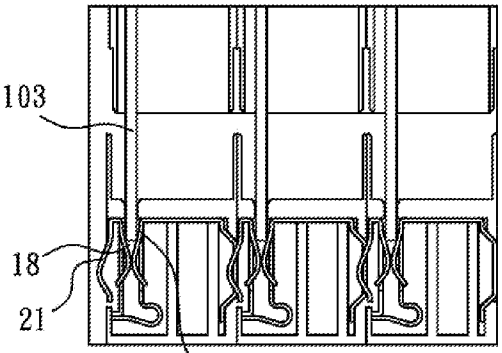
Figure 5C:
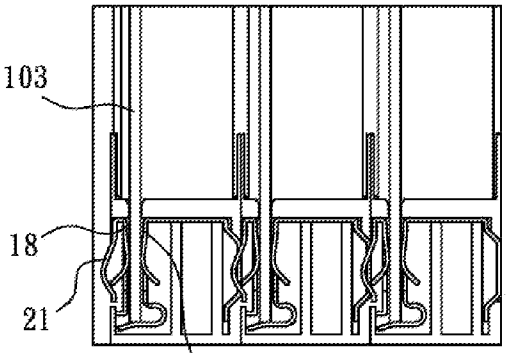

FIGS. 5A-5C illustrate cross-sectional view of the connector module of the present invention in application. As shown, in the state of FIG. 5A, the foreign object (the circuit board) 103 is just inserted into the slot 18, from the upper part of the figure to the lower part, but has not yet entered the slot 18. In this time point, the second contact 24A and the fifth contact 29A, and the third contact 25A and the sixth contact 30A, respectively, maintain in electrical contact.

In the state shown in FIG. 5B, the foreign object 103 first contacts the second contact 24 and the fifth contact 29, followed by a continuous movement to force the second contact 24 and the fifth contact 29 to break, therefore releasing the contact status of the second contact 24A and the fifth contact 29A. Thereafter, the foreign object 103 continues to move along the first direction X and contacts the third and the sixth contacts 25A, 30A. The continuous movement of the foreign object 103 forces the third and sixth contacts 25A, 30A to break, therefore releasing the contact status of the third and sixth contacts 25A, 30A, as shown in FIG. 5C.

Since contact pings 104, such as goldfingers 104 provided in both sides of the circuit board 103, are provided at locations corresponding to the second contact 24A, the third contact 25A and the fifth contact 29A and the sixth contact 30A, the contact pins 104 will form electrical contacts with the second contact 24A and the fifth contact 29A and/or the third contact 25A and the sixth contact 30A, when the circuit board 103 is fully inserted in the slot. Depending on the length of the contact pins 104, the contact pins 104 may be provided at regions corresponding to the second contact 24A and the fifth contact 29A, to the third contact 25A and the sixth 30A or to second contact 24A and the fifth contact 29A and extending to regions corresponding to the third contact 25A and the sixth contact 30A.

When the circuit board 103 is inserted and reaches the bottom of the slot 18, forcing the third contact 25A to and the sixth contact 30A to separate, depending on the length of the contact pins 104, the contact pins 104 may form electrical contacts with the second contact 24A and the fifth contact 29A, with the third contact 25A and the sixth 30A or with all the second contact 24A, the fifth contact 29A, the third contact 25A and the sixth contact 30A. When the contact pins 104 contacts all the second contact 24A, the fifth contact 29A, the third contact 25A and the sixth contact 30A, signals/currents that enter from the first contact 23A, flow via the second and fifth contacts 24A, 29A and the third and sixth contacts 25A, 30A and exit from the fourth contact 28A, when the circuit board 103 is not inserted in the slot 18, will enter the circuit provided in the circuit board 103 from the contact pin 104, to be processed or transformed by the circuit. Results of the processing or transformation will be output to external via the contact pin 104 or otherwise. A serial connection of the circuit board is thus realized. On the other hand, if after insertion of the circuit board 103, the contact pins 104 form electrical contacts with the second and fifth contacts 24A, 29A, only, signals/currents that enter from the first contact 23A and exit from the fourth contact 28A, when the circuit board 103 is not inserted in the slot 18, will generate a split current to enter the circuit provided in the circuit board 103 from the contact pin 104, due to the contacts of the contact pins 104 with the second and fifth contacts 24A, 29A. The signals/currents are processed or transformed by the circuit and output to external. A parallel connection of the circuit board is thus realized.

In the process describe above, when the circuit board 103 forces the second contact 24A and the fifth contacts 24A to separate, the third contact 25A remains in contact with the sixth contact 30A; maintaining electrical conduction between them. When the circuit board 103 forces the third contact 25A to separate from the sixth contact 30A, the second contact 24A and the fifth contacts 29A have formed conduction with the contact pins 104. Sudden break in the circuit due to the break of the contacts may thus be prevented. On the other hand, when the circuit board 103 is removed from the slot 18 and moves opposite to the first direction X, the third and sixth contacts 25A, 30A will form contact at the first place. When this happens, the second and fifth contacts 24A, 29A remain in contact with the contact pins 104 and electrical connection is maintained. When the circuit board 103 leaves the second and fifth contacts 24A, 29A, making them form contact, the third and sixth contacts 25A, 30A are already contacted and are in conduction. Therefore, sudden short in the entire circuit can be prevented.

As described above, the present invention provides a connector module that supports the hot-swap function. With the present invention, sudden short or break due to the insertion or removal of a foreign circuit may be prevented.

What is claimed is:

1. A connector module, comprising:

an insulation main body having a slot;

at least one group of connection terminals fixed on the insulation body, each group of connection terminals including a first contact piece and a second contact piece; wherein:

the first contact piece provides an external first contact and internal second and third contacts, the internal second and third contacts being arranged along a first direction in the slot;

the second contact piece provides an external fourth contact and internal fifth and sixth contacts, the internal fifth and sixth contacts being arranged along the first direction in the slot and in resilient contact with the second and third contacts, respectively; and a width of the slot in a direction perpendicular to the first direction is enough to accommodate a foreign object, whereby when the external object enters into the slot in the first direction, contact between the second and fifth contacts or the third and sixth contacts is released.

2. The connector module of claim 1, wherein the first contact is positioned on the external of a first side of the insulation body and the fourth contact is positioned on the external of a second side of the insulation body opposite to the first side.

3. The connector module of claim 2, wherein at least a portion of the first elastic leg is arranged on the external of the first side of the insulation main body and at least a portion of the fourth elastic leg is arranged on the external of the second side of the insulation main body.

4. The connector module of claim 1, wherein the first contact piece comprises a connection portion and a first elastic leg, a second elastic leg and a third elastic leg extended from the connection portion and wherein the first contact, the second contact and the third contact are provided in the first elastic leg, the second elastic leg and the third elastic leg, respectively.

5. The connector module of claim 4, wherein the first contact is positioned on the external of a first side of the insulation body and the fourth contact is positioned on the external of a second side of the insulation body opposite to the first side.

6. The connector module of claim 5, wherein at least a portion of the first elastic leg is arranged on the external of the first side of the insulation main body and at least a portion of the fourth elastic leg is arranged on the external of the second side of the insulation main body.

7. The connector module of claim 4, wherein the third elastic leg surrounds at least a portion of the second elastic leg, with a space between them.

8. The connector module of claim 7, wherein the third elastic leg surrounds the entire second elastic leg, with a space between them.

9. The connector module of claim 1, wherein the second contact piece comprises a main body and a fourth elastic leg, a fifth elastic leg and a sixth elastic leg extended from the main body, wherein the fourth contact, the fifth contact and the sixth contact are provided in the fourth elastic leg, the fifth elastic leg and the sixth elastic leg, respectively.

10. The connector module of claim 9, wherein the first contact is positioned on the external of a first side of the insulation body and the fourth contact is positioned on the external of a second side of the insulation body opposite to the first side.

11. The connector module of claim 10, wherein at least a portion of the first elastic leg is arranged on the external of the first side of the insulation main body and at least a portion of the fourth elastic leg is arranged on the external of the second side of the insulation main body.

12. The connector module of claim 9, wherein the sixth elastic leg surrounds at least a portion of the fifth elasticity leg, with a space between them.

13. The connector module of claim 12, wherein the sixth elastic leg surrounds the entire firth elastic leg, with a space between them.

* * * * *